United States Patent [19]

Pegon, Jr.

[11] 4,429,512

[45] Feb. 7, 1984

[54] TRAY-LOADING MACHINE

[75] Inventor: Alexander A. Pegon, Jr., Norristown, Pa.

[73] Assignee: Diversified Eastern, Inc., Trexlertown, Pa.

[21] Appl. No.: 227,582

[22] Filed: Jan. 23, 1981

[51] Int. Cl.[3] ..... B65B 35/44; B65B 35/46

[52] U.S. Cl. ..... 53/534; 53/539; 53/246; 53/247; 53/251

[58] Field of Search ..... 53/48, 534, 537, 539, 53/543, 246, 247, 251

[56] References Cited

U.S. PATENT DOCUMENTS

| | | | |
|---|---|---|---|
| 2,735,599 | 2/1956 | Thurman | 53/539 X |
| 3,225,513 | 12/1965 | Ehe | 53/539 X |
| 3,303,759 | 2/1967 | Burke | 53/539 X |
| 3,314,213 | 4/1967 | Peppler | 53/246 X |
| 3,512,336 | 5/1970 | Rosecrans | 53/539 X |
| 3,572,005 | 3/1971 | Allen et al. | 53/534 |
| 4,009,553 | 3/1977 | Monjo | 53/246 X |

*Primary Examiner*—Horace M. Culver

*Attorney, Agent, or Firm*—Dann, Dorfman, Herrell & Skillman

[57] ABSTRACT

An apparatus is provided for loading containers into a carrier tray having individual rows of cutouts for receiving the containers. The apparatus includes feed control conveyors for spacing the containers at a uniform predetermined distance and a gating mechanism for directing the containers into a plurality of feed lines. The feed lines include feed-control screws which cooperate to advance the containers so that a container is discharged from the end of each feed line simultaneously, the discharge containers being laterally aligned in a transverse row. A container conveyor advances the aligned containers discharged from the feed lines. A tray conveyor underlying the container conveyor receives and advances carrier trays so that the aligned containers reach the discharge end of the container conveyor simultaneously with a row of cutouts in a tray, the containers falling downwardly directly into the row of cutouts in the tray.

10 Claims, 5 Drawing Figures

TRAY-LOADING MACHINE

BACKGROUND OF THE INVENTION

The present invention relates to a tray-loading machine and is particularly applicable to a machine for loading cups of dairy products into carrier trays having individual cutouts for receiving the cups.

Prior to the present invention, cups of dairy products were loaded into such trays by pickup mechanisms which lifted the cups from a feed conveyor belt and deposited the cups into the cutout receptacles in the carrier trays. The prior art tray-loading machines required precise adjustment to guard against damage to the cups of dairy products and were expensive to purchase, operate and maintain.

The present invention provides a tray-loading machine which is substantially less expensive than the prior art tray-loading machines and yet is fully effective in operation and use to load cups of dairy products into trays without damaging the cups of dairy products and also without causing the products to spill or splash during tray loading.

More particularly, the present invention provides a tray-loading machine which receives the cups of dairy products from the filling machine, operates to align the cups side-by-side in transverse rows and thereafter to deposit the rows of cups into the carrier trays in continuous operation.

SUMMARY OF THE INVENTION

Briefly stated, the present invention provides an apparatus for loading containers into a carrier tray having individual rows of cutouts for receiving the containers. The apparatus comprises infeed means for introducing a flow of containers into the apparatus and feed-control means for receiving the containers and spacing the containers at a uniform predetermined distance from each other. At least first and second parallel feed lines are provided downstream from the feed-control means. A gate means is included for sequentially directing containers from the feed-control means to either the first or the second feed lines. The first and second feed lines include feed-control screws which cooperate to advance the containers in each feed line so that a container is discharged from the end of each feed line simultaneously, the discharged containers being laterally aligned in a transverse row. Container conveyor means is provided for receiving and advancing the aligned row of containers discharged from the feed lines. Tray conveyor means underlying and synchronized with the container conveyor means receives and conveys carrier trays whereby each of the aligned rows of containers reach the discharge end of the container conveyor simultaneously with a row of cutouts in a tray so that the row of containers falls downwardly directly into the row of cutouts in the tray.

BRIEF DESCRIPTION OF THE DRAWINGS

All of the objects of the present invention are more fully set forth hereinafter with reference to the detailed description of a preferred embodiment of the apparatus illustrated in the accompanying drawings, wherein.

DESCRIPTION OF A PREFERRED EMBODIMENT

Figure 1:
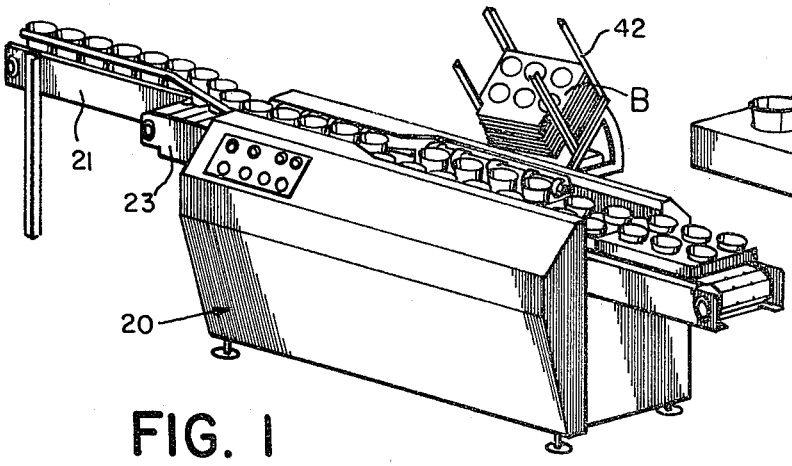
FIG. 1 is a perspective view of a tray-loading machine embodying the present invention.
Figure 2:
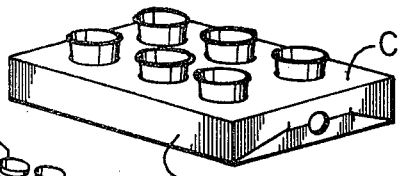
FIG. 2 is a perspective view of a carrier tray having six cups loaded thereinto.
Figure 5:
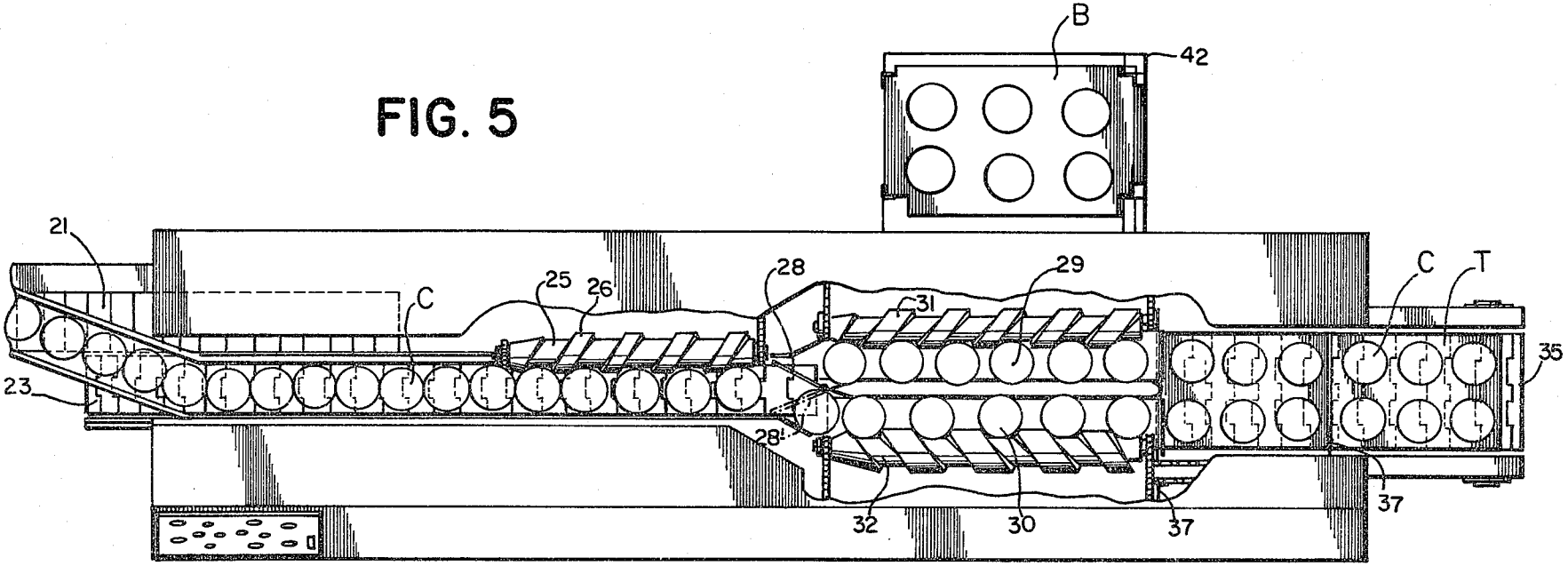
FIG. 5 is a plan view of the apparatus as seen from the line 5—5 of FIG. 3 with portions broken away to illustrate the operative elements of the machine.

Referring to the drawings, as best shown in FIGS. 1 and 2, the containers or cups C to be loaded into trays T are fed to the tray loading machine 20 from a supply line, for example, the output of a cup filling operation (not shown). The cups C are illustrated in FIG. 1 as arriving in an edge-to-edge abutting relationship on an infeed means, for example, an infeed conveyor line 21. From the infeed conveyor 21, the cups are shifted laterally onto a feed conveyor 23 which advances the cups into a feed-control means, for example, a feed-control screw 25 (best shown in FIG. 5). The feed-control screw 25 receives the cups C between the screw flights and positively positions the cups in a predetermined spaced relation to each other as shown in FIG. 5.

The feed-control screw 25 also precisely controls the advance of the cups so that they are fed at properly timed intervals into a gate means 27 which diverts the cups alternately into side-by-side feed lines 29 and 30, respectively. While in this embodiment two feed lines 29 and 30 are shown, the the present invention is not so limited and may involve three or more such feed lines. The feed line 29 has a rotating feed-control screw 31 associated with it and likewise the feed line 30 has a rotating feed-control screw 32 associated with it. The feed-control screws 31 and 32 are coordinated in order to advance the cups in each feed line at a predetermined proper rate so that at the discharge end of the two feed lines 29 and 30 the cups in the two feed lines are laterally aligned in a transverse row in side-by-side relationship.

Figure 4:
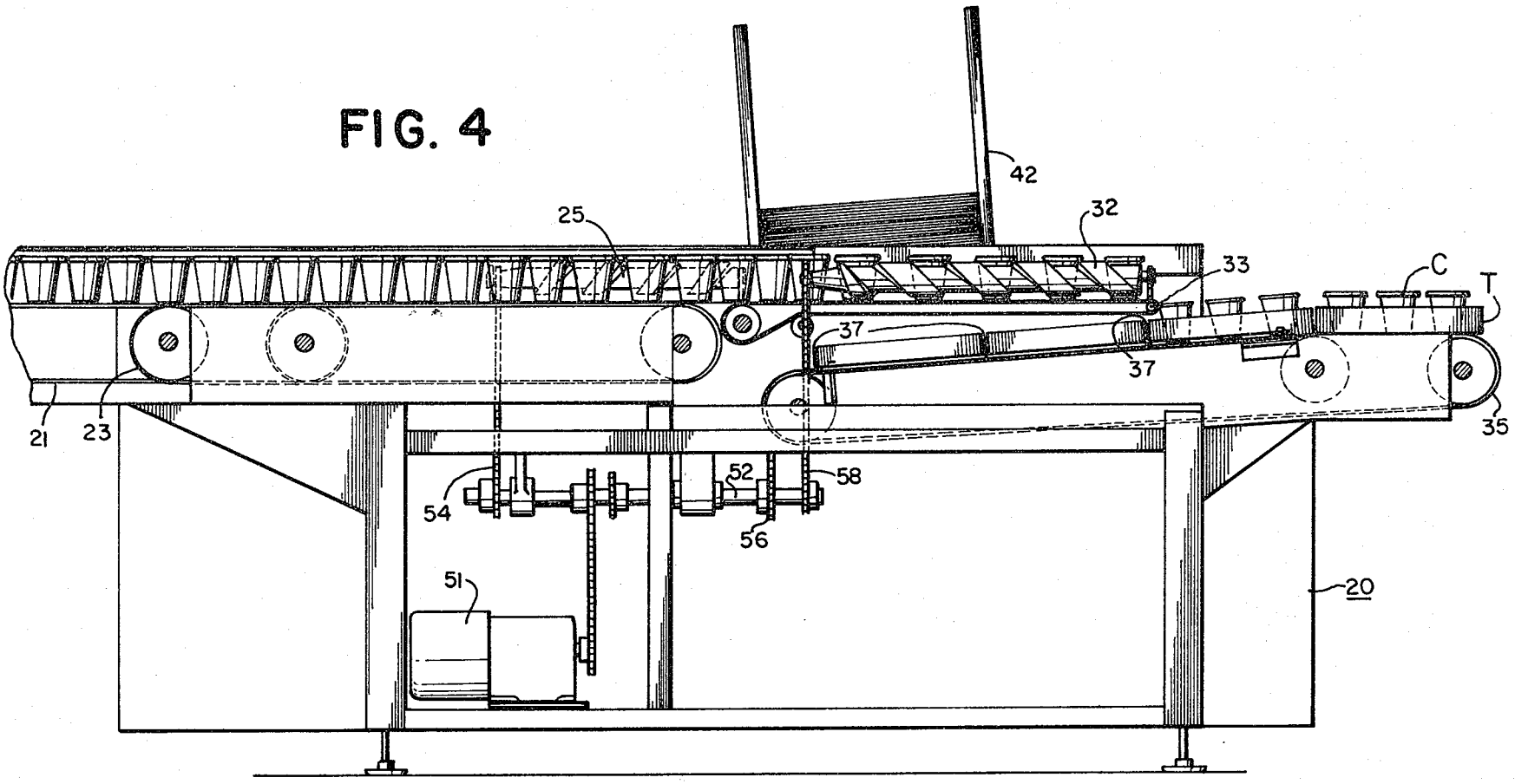
FIG. 4 is a longitudinal sectional view as seen from the line 4—4 of FIG. 3.

In their travel along the feed lines 29 and 30, the cups C are supported and advanced by an underlying container conveyor means, for example, cup conveyor 33 which terminates slightly beyond the discharge ends of the feed screws 31 and 32 (best shown in FIG. 4). Underlying the cup conveyor 33 is a tray conveyor means, for example, tray conveyor 35 which, as shown in FIG. 4, slopes upwardly under the discharge end of the cup conveyor 33. The purpose of the tray conveyor 35 is to carry empty trays T under the end of the cup conveyor 33 and into a position as shown in FIG. 4 so that the suitably sized cutouts in the upper surface of the trays receive the cups as they are discharged from the feed control screws 31 and 32 over the end of the cup conveyor 33. The trays T are fed to the tray conveyor 35 and are accurately positioned thereon to precisely coordinate with the discharge of the cups C from the feed control screws 31 and 32.

Figure 3:
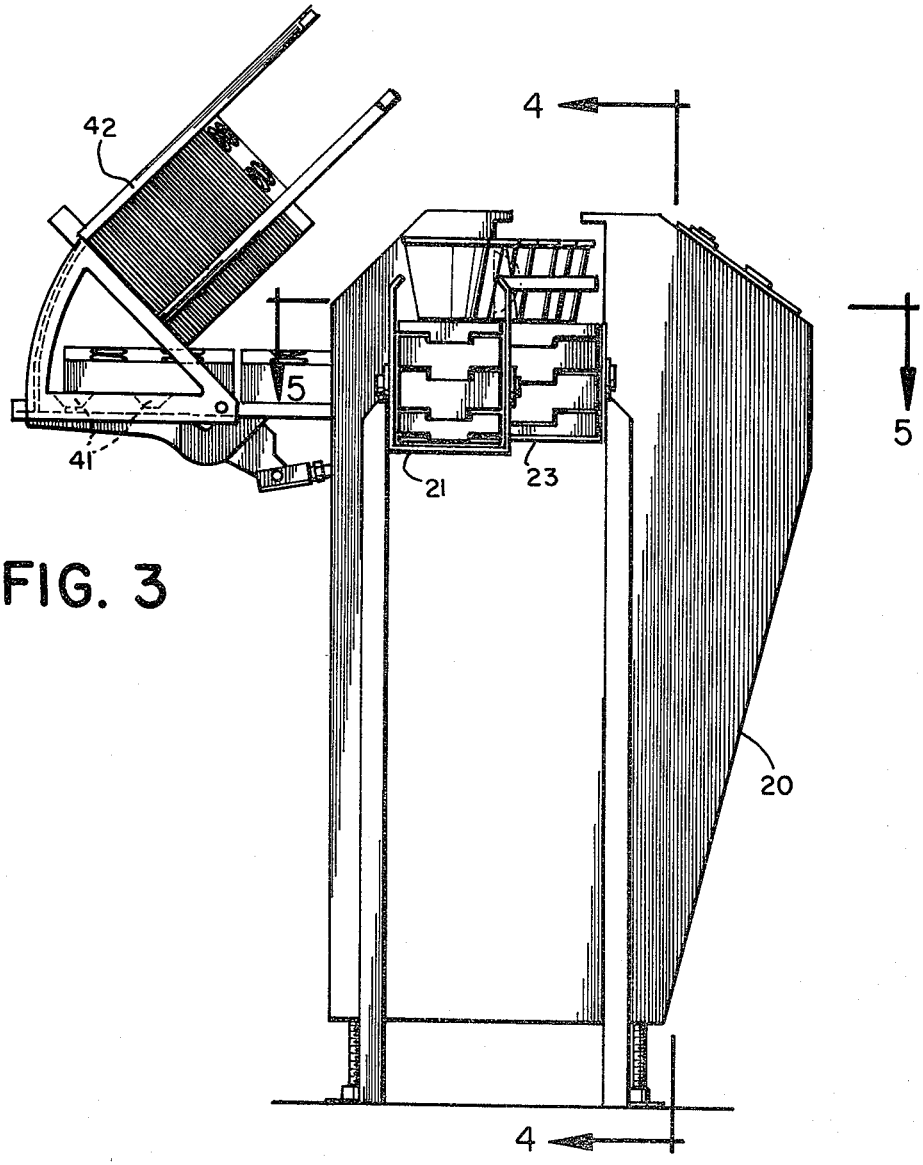
FIG. 3 is an end elevation of the apparatus shown in FIG. 1 as seen from the lefthand end.

In the present embodiment, the trays T are formed in the machine 20 from generally rectangular blanks B. The blanks B are flattened or collapsed when they are initially stacked in the machine 20 as shown in FIGS. 1 and 3. Suitable equipment for forming the trays T from the flat blanks B is known and commercially available. A detailed explanation of the structure and operation of such tray forming equipment is not necessary for a complete understanding of the present invention. As shown, each of the blanks B is initially fed from the stack through suitable pneumatic suction devices 41 which withdraw the blank B from the stack mechanism 42 through suitable guides (not shown) causing the blank B to open itself up. The blank B is then passed through further guide mechanisms which fold and tuck the end flaps of the blank B to interlock with one another and set up the blank B into a stable self-supporting tray T as shown in FIG. 2. After the tray T is formed, the tray is fed onto the tray conveyor 35 as shown in FIG. 4. The tray conveyor 35 thereafter advances the tray to a position under the discharge end of the cup conveyor 33 whereupon the cup conveyor 33 discharges the cups C directly into the appropriate cutouts in the upper surface of the tray T.

The apparatus which has been described above is particularly designed to handle cups of dairy products, for example, cottage cheese, which must be handled with care in order to avoid spillage or splashing of the dairy products and/or damage to the relatively fragile cups.

The containers or cups C are supported throughout their travel through the tray loading machine 20 by slat type conveyors 21, 23 and 33 of a known type which are commercially available. The slats of the slat conveyors are interconnected to provide a smooth transition between adjacent slats which enables the cups to slide from one slat to the next without significant impedance while they are being positioned by the feed screws 25, 31 and 32. By being slidable on the underlying conveyors, the containers C are not subject to significant jostling as they are carried through the machine. Conveyors of this type are readily cleaned and sterilized so as to avoid contamination when product is inadvertently spilled during the tray loading operation.

As shown in the drawings, the infeed conveyor 21 carries the cups C from a filling or other operation, either directly or through a chill room or refrigerator, as required by the product being packaged in the cups or containers. The infeed conveyor 21 is the final conveyor from the production line in advance of the tray loading machine 20 and it is preferably operated to accumulate a sufficient supply of cups in edgewise abutting relationship to provide for a continuous feed of the cups to the tray loading machine 20.

As shown in FIG. 5, the cups on the infeed conveyor 21 are transferred laterally onto the feed conveyor 23. The rate of travel of the feed conveyor 23 is closely coordinated with the rotary speed of the feed-control screw 25 to provide a uniform flow of cups into the spaces between the flights 26 of the feed-control screw 25. As shown in FIG. 5, the flights 26 are of uniform width throughout the length of the screw 25 and project inwardly to engage the tapered sidewalls of the cups C on the feed conveyor 23. In operation, the rate of travel of the feed conveyor 23 is slightly greater than the rate of linear travel of the flights 26 so that the feed conveyor 23 tends to urge the cups C forwardly against the trailing edge of each flight 26. Since the pitch of the flights 26 is greater than the largest diameter of the cup C, the feed-control screw 25 effects an even spacing of the cups as they are advanced by the feed conveyor 23. Thus, the cups to the left or entrance end of the feed-control screw 25 are positioned in edge-to-edge abutting relationship, but the cups which are discharged from the right or outlet end of the feed-control screw 25 are positioned with a predetermined, uniform spacing therebetween.

As the feed-control screw 25 is rotated in timed relation to the feed conveyor 23, the right-most cup is disengaged from the feed-control screw 25 and the feed conveyor 23 carries the cup forwardly into the gate mechanism 27. The gate mechanism 27 is operated in timed relation to the rotation of the feed control screw 25 so that the gate 28 is positioned as shown in full lines in FIG. 5 when the first cup is discharged from the feed-control screw 25, thereby causing the cup to advance into engagement with the feed screw 32 of feed line 30. As the next cup is advanced by the feed conveyor 23 and is released from the feed-control screw 25, the gate 28 is shifted to the broken-line position 28' shown in FIG. 5 so that the next cup is displaced by the gate 28 to the feed line 29 and into engagement with the feed control screw 31. The alternate shifting of the position of the gate 28 continues as long as the flow of cups is advanced from the feed-control screw 25.

Because of the difference in the pitch angle of the flights in the screws 31 and 32, respectively, the spacing between the cups as controlled by the flights is different in the two lines. In this fashion, the advance of the cups in the two lines 29 and 30 is controlled by the feed screws 31 and 32 and there is little or no opportunity for jam-ups to occur which might otherwise occur if the cups were permitted to have uncontrollable movement between the feed-control screw 25 and the respective feed-control screws 31 and 32. As shown in FIG. 5, feed-control screw 31 has a shallower pitch than feed-control screw 32 so that the advance of the cups in feed line 29 is delayed relative to the advance of the cups in the feed line 30. In this manner, a cup in feed line 30 catches up with the proceeding cup previously discharged into feed line 29 as the two feed-control screws 31 and 32 are rotated in unison. The flights of the feed-control screws 31 and 32 terminate at substantially the same point at the righthand end of feed lines 29 and 30 so that the cups in the two feed lines 29 and 30 are freed from the feed-control screws 31 and 32 simultaneously. By the accurate control of the cups through the medium of the feed-control screws 31 and 32, respectively, the cups are discharged therefrom in transverse rows consisting of laterally aligned pairs. The row of aligned cups are advanced together by the cup conveyor 33 which underlies both of the feed lines 29 and 30. As with the feed conveyor 23 in relation to the feed-control screw 25, the cup conveyor 33 is advanced at a linear rate slightly greater than the linear rate of advance of the flights of the feed-control screws 31 and 32 so that the cup conveyor 33 tends to tip the bottoms of the cups forward as they are discharged from the feed-control screws 31 and 32.

In order to synchronize the position of tray T with the discharge of an aligned pair of cups from the end of the cup conveyor 33, the tray conveyor means including pusher flaps 37. The pusher flaps 37 overlie the tray conveyor 35 and engage behind the trays T and insure that each tray is in the proper position with the cutouts in the tray underneath the discharge end of the cup conveyor 33 when the aligned pair or row of cups is discharged. The timing of the advance of the conveyor flaps 37 is coordinated with the discharge of the cups from the feed-control screws 31 and 32 so that each aligned pair or row of cups discharged from the screws 31 and 32 is in position to fall precisely within an aligned pair or row of the cutouts in a tray T. The greater speed of the cup conveyor 33 in relation to the rate of travel of the feed-control screws 31 and 32 insures that the cups are discharged over the end of the cup conveyor 33 with the proper angle of tilt so that they fall directly into the cutouts in the tray without undue damage to the cups or spilling of the contents of thereof.

The coordination of the operation of the various conveyors and feed-control screws is accomplished by the use of a common drive shaft for all of the elements. As shown in FIG. 4, a single drive motor 51 is coupled to a common drive shaft 52 having power takeoffs by means of chain and sprockets as indicated at 54, 56 and 58 to the respective feed-control screws. The drives to the conveyors 23, 33, 35 and 37 are likewise taken from the common drive shaft 52 to insure coordination between the travel of the conveyors and the feed-control screws respectively. Thus, by employing a common drive means, in the present instance a common drive shaft 52, it is possible to vary the speed of the operation as a whole without disturbing the relationship between the advances in the separate parts of the tray loading operation.

While a particular embodiment of the present invention has been herein illustrated and described, it is not intended to limit the invention to such disclosure, but changes and modifications may be made therein and thereto within the scope of the following claims.

I claim:

1. An apparatus for loading containers into a carrier tray having individual rows of cutouts for receiving the containers comprising:

infeed means for introducing a flow of containers into the apparatus;

feed-control means for receiving the flow of containers, for spacing the containers at a uniform predetermined distance from each other within a flow line and for discharging the spaced containers;

at least first and second parallel feed lines downstream from said feed-control means;

gate means for sequentially directing containers discharged from the feed-control means to either said first or said second feed lines;

said first feed line including a first feed-control screw and said second feed line including a second feed-control screw, the first and second feed-control screws having different pitches and cooperating to advance the containers in each feed line so that a container is discharged from the end of each feed line simultaneously, the discharged containers being laterally aligned in a transverse row;

container conveyor means for receiving and advancing the aligned row of containers discharged from the first and second feed lines; and tray conveyor means underlying the container conveyor means for receiving and conveying carrier trays, said tray conveyor means being synchronized with said container conveyor means whereby each of said aligned rows of containers reach the discharge end of said container conveyor means simultaneously with a row of cutouts in a tray so that the row of containers fall downwardly directly into said row of cutouts in said tray.

2. The apparatus as recited in claim 1 wherein the tray conveyor means underlies the container conveyor means at an angle and the container conveyor means includes means for tilting the containers as they fall off of the discharge end of the container conveyor means so that the containers are angularly aligned with the cutouts in the trays.

3. The apparatus as recited in claim 2 wherein said tilting means comprises said first and second feed-control screws which cooperate to retain the upper portions of the containers against the pull of the container conveyor means, thereby tilting the containers.

4. The apparatus as recited in claims 1 or 3 wherein the feed-control means comprises a third feed-control screw.

5. The apparatus as recited in claims 1 or 3 wherein the infeed means, the container conveyor means and the tray conveyor means each comprise slat type conveyors.

6. The apparatus as recited in claim 1 wherein the infeed means, the feed control means, the first and second feed-control screws, the container conveyor means and the tray conveyor means are all driven by a single motor through a common drive shaft and chain-and-sprocket connection.

7. The apparatus as recited in claim 1 further including means for setting up the carrier trays from flattened blanks.

8. The apparatus as recited in claim 1 further including pusher flaps for synchronizing the tray conveyor means with the container conveyor means.

9. The apparatus as recited in claim 1 wherein said gate means comprises a deflector gate and means to shift said gate between alternative positions respectively in registry with said first and second feed lines.

10. The apparatus as recited in claim 9 having a common mechanical drive for both said means to shift said gate, and said first and second feed-control screws to thereby synchronize said gate shifting with said feed-control screws.

* * * * *